US006807906B1

(12) United States Patent
DeMoore et al.

(10) Patent No.: US 6,807,906 B1
(45) Date of Patent: Oct. 26, 2004

(54) ZONED ULTRAVIOLET CURING SYSTEM FOR PRINTING PRESS

(75) Inventors: Howard W. DeMoore, Dallas, TX (US); Dan Cunningham, Marshall, MO (US); Howard C. Secor, Krum, TX (US)

(73) Assignee: Printing Research, Inc., Dallas, TX (US)

( * ) Notice: Subject to any disclaimer, the term of this patent is extended or adjusted under 35 U.S.C. 154(b) by 58 days.

(21) Appl. No.: 10/439,858

(22) Filed: May 16, 2003

(51) Int. Cl.[7] ..... B41F 35/00

(52) U.S. Cl. ..... 101/424.1; 101/488; 362/218; 427/511

(58) Field of Search ..... 101/424.1, 416.1, 101/487, 488; 427/510–511, 557–559; 34/273, 274; 362/216–219

(56) References Cited

U.S. PATENT DOCUMENTS

| | | | | | |
|---|---|---|---|---|---|
| 1,440,077 | A | * | 12/1922 | Heitz | 49/153 |
| 3,819,929 | A | * | 6/1974 | Newman | 362/218 |
| 4,665,627 | A | * | 5/1987 | Wilde et al. | 34/278 |
| 4,809,608 | A | | 3/1989 | Wolnick et al. | 101/416.1 |
| 5,010,659 | A | * | 4/1991 | Treleven | 34/269 |
| 5,060,125 | A | * | 10/1991 | Cowie et al. | 362/218 |
| 5,176,077 | A | | 1/1993 | DeMoore et al. | 101/142 |
| 5,537,925 | A | | 7/1996 | Secor et al. | 101/424.1 |
| 5,595,118 | A | * | 1/1997 | Villaverde et al. | 101/424.1 |
| 5,598,777 | A | | 2/1997 | DeMoore et al. | 101/177 |
| 5,651,316 | A | | 7/1997 | DeMoore et al. | 101/450.1 |
| 5,832,833 | A | * | 11/1998 | Burgio | 101/424.1 |
| 5,979,325 | A | * | 11/1999 | Mitze et al. | 101/488 |
| 6,026,748 | A | * | 2/2000 | Reed et al. | 101/424.1 |
| 6,280,801 | B1 | * | 8/2001 | Schmitt | 427/511 |

FOREIGN PATENT DOCUMENTS

| | | | | |
|---|---|---|---|---|
| WO | WO 200216139 A1 | * | 2/2002 | B41F/35/00 |

* cited by examiner

*Primary Examiner*—Minh H Chau
(74) *Attorney, Agent, or Firm*—Conley Rose, P.C.; Michael W. Piper

(57) ABSTRACT

A zoned UV curing system for drying UV inks and coatings in printing presses. A plurality of linear UV lamps are spaced apart laterally across the travel path of substrates in a press. The axis of each lamp is aligned generally with the travel path, but may be slanted slightly so that every point on the travel path passes directly under at least one lamp. Power supply and control means allow selection of which lamps are powered, so that unneeded lamps may be turned off to save power. The power level of each lamp is variable. One transverse UV lamp may be placed upstream to initiate curing before substrates pass the zoned system. An IR heater may be placed upstream to preheat UV ink and coatings to enhance curing and to smooth coatings.

25 Claims, 5 Drawing Sheets

ZONED ULTRAVIOLET CURING SYSTEM FOR PRINTING PRESS

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

The present invention relates to ultraviolet sources for curing ultraviolet sensitive inks and coatings, and more particularly to an ultraviolet curing system for printing presses which is zoned to allow for adjustment for various printing area widths.

Rotary offset printing presses reproduce an image on a substrate comprising successive sheets of paper, or a web of paper, by means of a plate cylinder which carries the image, a blanket cylinder which has an ink transfer surface for receiving the inked image, and an impression cylinder which presses the paper against the blanket cylinder so that the inked image is transferred to the substrate. Lithographic inks applied to the substrate can be partly absorbed and dry mainly by oxidation, penetration and absorption. Drying of lithographic inks can be enhanced by oxidation, penetration and absorption at somewhat elevated temperatures. Heat may be applied to the substrates by various means, see for example U.S. Pat. No. 5,537,925 which applies infra-red radiant heat and heated forced air flow to speed drying of such inks.

For multicolor printing, presses normally have a number of printing stations, one for each color. Dryers are often placed between printing stations to dry each image before the substrate enters the next printing station. At the end of the printing press, the substrates are normally delivered to a sheet stacker. A dryer is normally provided before the stacker to avoid any offsetting of images from substrates which are not completely dried.

In many applications, a protective or decorative coating is applied to printed substrates. As taught in U.S. Pat. No. 5,176,077, coating apparatus is available for installation in a conventional printing press. Such coatings should also be dried before the printed substrates are delivered to a stacker.

It is becoming more common to use ultraviolet, UV, curable inks and coatings in rotary offset printing presses and other types of presses, e.g. flexographic, screen printing, etc. UV coatings may be applied as protective or decorative coatings over images printed with other types of inks. UV inks and coatings have a number of advantages. They do not contain water or volatile hydrocarbon components and do not produce gases which have to be removed as normally occurs with other inks and coatings. Instead of drying by evaporation or oxidation, the UV curable materials polymerize in response to exposure to UV radiation.

UV curing units, commonly referred to as UV dryers, are available for installation in most printing presses. These available units generally use tubular quartz medium pressure mercury vapor lamps as a source of UV radiation. This type of lamp provides a fairly wide range of UV wavelengths which make them suitable for a variety of inks and coatings which may respond to different UV wavelengths. The conventional tubular lamps are positioned transversely across the width of the printing path. Multiple lamps spaced along the substrate travel path are used to increase total power and exposure, or dwell, time as necessary to achieve a good cure.

The mercury vapor lamps must be driven at relatively high power to generate a sufficient intensity of UV radiation to achieve rapid curing and to cure thick layers of UV inks and coatings. Such lamps also emit considerable energy in the visible and infrared frequencies which represents wasted energy and requires cooling fans to avoid overheating the lamps, the substrates and the printing presses. When printing a substrate of less width than the press capacity, all radiation, i.e. UV, IR, and visible from those portions of the lamps which extend beyond the edges of the substrate is wasted energy and is directed at press components and causes unnecessary aging and other damage to the press itself.

SUMMARY OF THE INVENTION

An ultraviolet curing unit according to the present invention includes a plurality of linear UV emitting devices spaced laterally from each other across a substrate travel path in a printing press and generally in alignment with the direction of the travel path. Each UV emitting device defines a curing zone. The UV emitting devices are individually controlled so that UV emitting devices for unneeded curing zones may be deactivated.

In a preferred form, each UV emitting device has a plurality of power settings, or a continuously adjustable power level, allowing adjustment according to the particular inks and/or coatings used in a particular printing job.

In another embodiment, the UV curing unit may include one UV lamp positioned transversely across the path of substrate travel. The transverse lamp initiates curing of UV curable inks and coatings before the printed substrate passes under the primary plurality of lamps.

In another embodiment, an infrared and/or hot air heater is positioned to heat the printed substrates before they are exposed to the UV emitting devices.

DETAILED DESCRIPTION OF THE INVENTION

As used herein, the term "substrate" refers to the material on which an image, text or coating is applied by a printing press. A substrate may be an individual sheet of paper, plastic, etc. or web stock of such materials. Substrates may also be in the form of board, corrugated board, foam core, signboard, any other printable material known in the printing arts or the like. The term "zones" refers to bands into which the substrate travel path is divided for the purposes of controlling the application of heat or UV radiation for drying or curing inks or coatings applied to the substrates.

Figure 1:
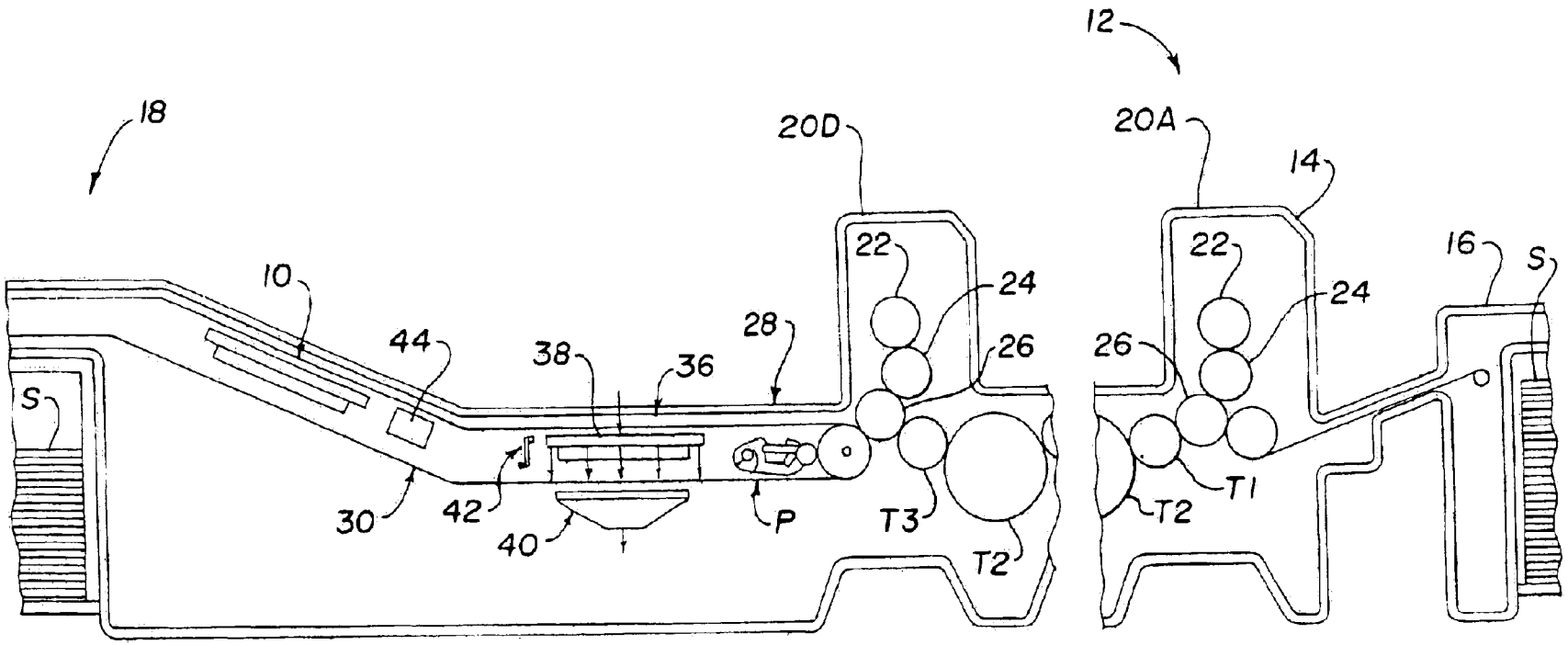
FIG. 1 is a schematic side elevation view of a multicolor offset rotary printing press with ultraviolet curing units and an infrared drying unit installed in one embodiment of the present invention.

With reference to FIG. 1, the installation of a zoned UV curing unit 10 according to the present invention in a typical multicolor printing press 12 is illustrated. In this embodiment, the press 12 is a sheet fed offset printing press. The unit 10 may be used in other types of presses, e.g. rotogravure, flexographic, screen printing, etc., and with other types of substrates. Such presses are typically capable of printing on substrates of twelve to over one hundred-inch width and may be capable of printing 10,000 sheets per hour or more.

Press 12 includes a press frame 14 coupled on the right end to a sheet feeder 16 from which sheets designated S are individually and sequentially fed into press 12. On the left end is a sheet delivery stacker 18 in which printed and dried sheets S are collected and stacked. Between sheet feeder 16 and delivery stacker 18 are four substantially identical offset printing units 20A through 20D, only two of which are shown. The invention is independent of the number of printing stations in a particular press.

As illustrated in FIG. 1, each printing unit 20A–20D is of conventional design, each unit including a plate cylinder 22, a blanket cylinder 24 and an impression cylinder 26. Freshly printed sheets from the impression cylinders 26 are transferred to the next printing unit by transfer cylinders T1, T2, and T3. The freshly lithographically printed sheets coming from printing unit 20D are protectively coated by means of a coating unit 28 which is positioned between the last printing unit 20D and the curing unit 10. Coating unit 28 may be the coating unit disclosed in U.S. Pat. No. 5,176,077, which is hereby incorporated by reference for all purposes. Other coating units may be used if desired.

The freshly printed and coated sheets S from printing unit 20D are conveyed to the delivery stacker 18 by a delivery conveyor system generally designated by the reference number 30. In this embodiment, several drying and curing units are mounted in the delivery system 30 to dry and cure inks and coatings on the substrates S before they are delivered into the delivery stacker 18. A thermal drying unit 36 includes a radiant heat lamp assembly 38, an extractor head 40 and temperature sensors 42. A preferred form of this thermal drying unit 36 is disclosed in copending U.S. patent application Ser. No. 09/645,759, filed Aug. 25, 2000 which is hereby incorporated by reference for all purposes. A conventional UV curing unit 44 comprising one or more UV lamps positioned across the conveyor 30 is located downstream from the thermal drying unit 36. A zoned UV curing unit 10 according to the present invention is positioned over conveyor 30 downstream from the conventional UV curing unit 44. The term downstream is use to indicate that a printed substrate from printing unit 20D travels first under the thermal unit 36, then under the UV unit 44 and lastly under the zoned curing unit 10. Other drying and/or curing units like units 36, 44 and 10 may also be included between the printing stations 20A and 20B, 20B and 20C, and 20C and 20D, if desired.

In a typical printing operation, substrates S from sheet feeder 16 are fed into press 12 sequentially. Each sheet S passes sequentially through printing stations 20A–20D in which multicolor text and images may be printed on the substrates. The coating unit 28 may apply a protective or decorative coating over part of, or the entire, printed substrate. The printing stations 20A–20D may apply conventional inks or UV curing inks. The coating unit will normally apply a UV curable coating over the conventional ink or UV curing ink text and images. The present disclosure is primarily concerned with curing of UV inks and coatings, and may be used with any substrate with a UV curable ink or coating, even if it also has been printed with conventional ink.

Although it is not necessary for curing of UV curable inks and coatings, the thermal drying unit 36 is preferred for several reasons. While heat itself does not cause UV inks and coatings to cure, the curing rate of such materials is affected by temperature. It is desirable therefore to heat the UV curable coatings on the substrates S to a known, or minimum, temperature to increase the rate of curing by units 44 and 10 and to improve the repeatability of curing by the UV units. The unit described in the above referenced patent application is preferred because it allows selection and automatic control of the substrate temperature.

Use of the thermal drying unit 36 to heat a UV curable film on a substrate also helps provide a smooth surface for the film. Heating the film causes thermal flow which allows surface tension to naturally smooth the film surface. It can reduce or even eliminate what is often referred to as the orange peel effect. While typical UV curing units also heat the coatings on substrates, some UV curing would occur and restrict or prevent thermal flow before surface smoothing could occur as a result of such heating. It is more effective to provide the heating upstream of the UV curing units so that the coating has time to smooth before UV curing occurs.

In the described embodiment, after a substrate with a UV curable ink and/or coating has passed under the thermal unit 36, it then passes under conventional UV curing unit 44, which acts as an initiator. The unit 44 is also not necessary for curing UV inks or coatings, because the main UV curing unit 10 is capable of full curing of the UV materials. It would generally not be used in flexographic presses. However, when it is used, the conventional unit 44 can initiate UV curing before the substrate reaches the main unit 10. This is believed to effectively improve the efficiency of the main unit 10 and may reduce overall power consumption. As noted above, the unit 44 may include one or more conventional UV curing lamps, e.g. mercury vapor lamps, with focused reflectors, For a forty-inch wide press, the lamp would typically be about forty-two inches wide and positioned perpendicular to, that is transversely across, the path of substrates traveling on the conveyor 30. The unit 44 may be air-cooled and/or may be a cool UV lamp having a water cooling tube between the actual UV lamp and the substrates.

Figure 2:
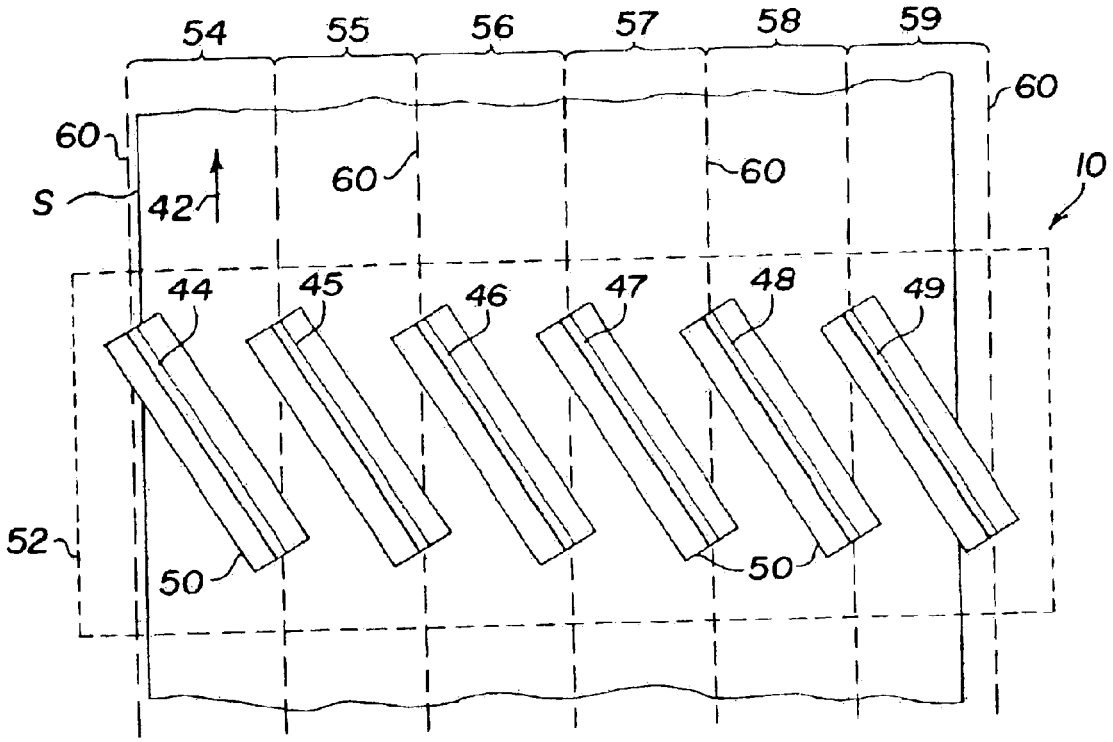
FIG. 2 is a top view of UV lamps of a UV curing unit according to the present invention and a printed substrate passing under the curing unit.

FIG. 2 illustrates a portion of one embodiment of a UV curing unit 10 of FIG. 1. In particular, it illustrates the positioning of UV emitting devices relative to each other and relative to a printed substrate S carried on delivery system 30 of FIG. 1. As illustrated by arrow 42, the substrate S is moving on a travel path under the UV curing unit 10 from bottom to top in FIG. 2. In this embodiment, the substrate S has a maximum width of forty inches. Six mercury vapor tubular lamps 44, 45, 46, 47, 48 and 49 are used as UV emitting devices. Each lamp 44–49 has a nominal diameter of one inch and a nominal light emitting length of about twelve inches. Each lamp is shown positioned above a rectangular aperture 50 in a plate 52 (shown in phantom) which forms the primary structural element on which curing unit 10 is assembled. Each aperture 50 has a length of about twelve inches, i.e. the same as the lamps 44–49, and a width of about three inches. The lamps 44–49 and apertures 50 are tilted about 33 degrees from the direction of travel 42 of the substrate S, which is vertical in FIG. 2.

The specific dimensions and angles of the preferred embodiment were selected for several reasons as will be explained in more detail below. When these reasons are understood, it will be apparent that other dimensions and angles will achieve the advantages of the present invention for presses having any nominal printing width.

The arrangement of lamps 44–49 shown in FIG. 2 defines six separate UV curing zones 54, 55, 56, 57, 58 and 59 on the substrate travel path, shown separated by dashed lines 60. Each zone is about seven inches wide providing a total illuminated width of about forty-two inches. Zones 54 and 59 extend about one inch beyond the edges of the maximum substrate S width of forty inches to account for end effects of lamps 44 and 49 and to ensure that the edges of a full width substrate S receive full UV illumination. Each zone 54–59 is primarily illuminated by one of the lamps 44–49, respectively. Each lamp 44–49 is separately powered and may be turned off if not needed for a particular printing job. For example, if a substrate S has a width of about twenty inches, the lamps 44 and 49 may be turned off, since no part of a twenty inch substrate S would pass under these two lamps. Since many printing jobs involve substrates of less than full width, this zoning arrangement saves a considerable amount of electrical power for the lamps 44–49 and reduces waste heat which must be removed. If lamps 44 and 49 were left on when printing twenty inch wide substrates, all of the UV radiation and heat generated by lamps 44 and 49 would be directed at press components, e.g. the conveyor system 30, causing unnecessary aging and other damage to such components.

The lamps 44–49 are positioned substantially in alignment with the travel path of substrate S. That is, the central axis or long dimension of the lamps 44–49 is substantially parallel to the travel path 42. It may be tilted somewhat to ensure uniform exposure across the substrate width, but the tilt should be less than 45 degrees. This provides a longer dwell or exposure time than is achieved with prior art transverse lamps. This increased dwell time improves curing of UV inks and coatings and allows higher production speeds. Prior art transverse bulb systems achieve increased total dwell time by using a number of transverse bulbs positioned across the entire width of the press and spaced along the travel path 42. Transverse lamps do not provide separately controllable zones like the present invention. In addition, the transverse tube arrangement exposes the substrates to a series of short exposures instead of to the longer continuous exposure provided by lamps aligned substantially with the substrate travel path.

While the lamps 44–49 have a nominal UV emitting length of twelve inches, end effects typically reduce the effective UV output from about one inch at each end. As can be seen from FIG. 2, the lamps are arranged so that the ends of the lamps 44–49 extend beyond the edges of the respective zones 54–59. The portions of the substrate travel path on the dividing lines 60 between adjacent zones 54–59 are therefore exposed to two adjacent lamps 44–49 so that they receive about the same total exposure as the portions lying in the centers of the zones 54–59. As noted above, the outermost edges of zones 54 and 59 extend beyond the maximum substrate S width to account for end effects.

Figure 3:
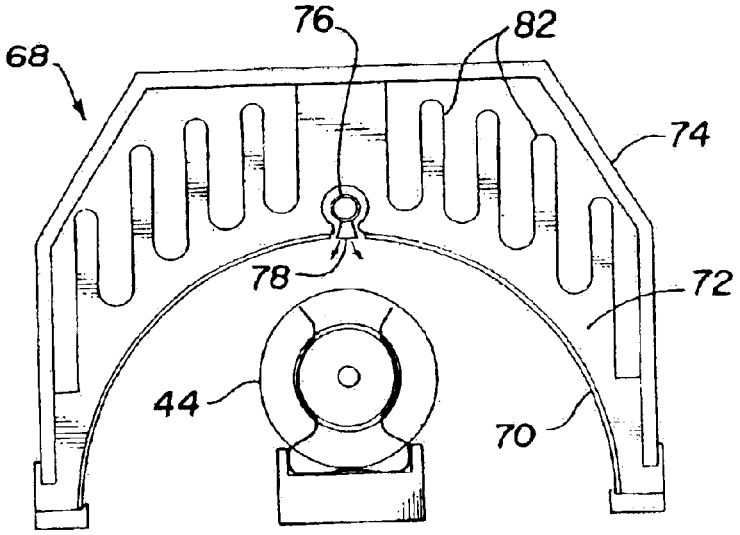
FIG. 3 is cross sectional view of a UV lamp assembly including a linear lamp, reflector and heat sink forming part of a UV curing unit according to a preferred embodiment.

FIG. 3 is a cross sectional illustration of lamp 44 and a complete lamp assembly 68 according to the present invention. In addition to the lamp 44, the assembly 68 includes a reflector 70, a heat sink 72 and an air conduit 74. A small pressurized air tube 76 having spaced air jets 78 is carried in a slot in heat sink 72. All of the lamps 44–49 are housed in a reflector and cooling assembly as illustrated in FIG. 3. The interior surface of heat sink 72 has the same shape as the reflector 70 and is in close contact to improve heat transfer from the reflector 70 to the heat sink 72. If the inner surface of heat sink 72 is highly polished or coated with a reflective material, the reflector 70 may be eliminated.

As illustrated in FIG. 3, the reflector 70 is substantially a half cylinder of aluminum having a highly polished inner surface. With this reflector shape and positioning of lamp 44, the emissions from lamp 44 are directed generally downward out of the housing 68 and through the apertures 50, FIG. 2. The heat sink 72 is preferably an extruded aluminum part having an inner half cylinder surface matching the shape of reflector 70 and a plurality of heat transfer fins 82 on its outer surface. The air conduit 74 mates with the outer finned surface of heat sink 72 to provide a controlled air flow path through which cooling air may be forced to flow through the fins 82. The air tube 76 provides a flow of clean, i.e. dust free, cool air through a series of vents or jets 78 aimed generally at the lamp 44. These air jets 78 prevent collection of dust or powder on the lamp 44.

The air jets 78 also cool the lamp 44 during operation and speed cooling when the lamp is turned off. The short lamps used in the embodiments of the present invention also naturally cool faster than long lamps. Fast cooling is desirable since mercury vapor lamps, such as the lamp 44, cannot be restarted until they cool sufficiently for the mercury to return to a liquid state. The short restart time provided by the present invention has several benefits. If the movement of substrates S is stopped for any reason, both thermal drying units and UV units must normally be turned off to avoid overheating the substrates. But, this means that the press cannot be restarted until the UV lamps have cooled sufficiently to be restarted. If the press needs to be opened for repair, maintenance or adjustment, UV lamps must normally be turned off to avoid exposing workers to the UV radiation. Even if an adjustment can be made quickly, the press cannot be restarted until the UV lamps have cooled sufficiently to restart. In some UV curing units with long transverse lamps which have a longer restart time, mechanical shutters are provided to block the UV radiation during times when printing stops or during repair, maintenance or adjustment of the press. While the use of shutters allows immediate restart of the press, the shutters represent increased cost and complexity of the system. The embodiments described herein reduce or avoid the need for shutters because they use short air cooled lamps which have a short restart time. For example, a typical forty two inch transverse mercury vapor lamp has a restart time of about five minutes, while the air cooled twelve inch lamps of this embodiment can be restarted in about one and one-half minutes.

The UV emissions from the lamps 44–49 are directed by reflectors 70 so that a majority of the output is directed down through the apertures 50 onto the substrate S. Prior art UV systems are generally designed to provide sharp focusing of the output of UV lamps on the surface of a substrate to achieve the maximum intensity on the substrate. For such focusing to be effective, the prior art lamps must be spaced a certain distance from the substrate. In the preferred embodiment, the reflectors are not shaped to form a sharp linear focus on the substrate S. Instead, they are designed to provide a broad more diffuse beam down through the apertures 50. The apertures 50 are about twelve inches long and about three inches wide. With this arrangement, each lamp 44–49 provides a substantially uniform UV exposure to an area of the substrate having at least the dimensions of the apertures 50 and extending somewhat on either side of the apertures 50. There is no need to space the curing unit 10 any specific distance from the substrate S for focusing purposes. The unit 10 may therefore be used in a variety of press types in which it may be spaced at different distances from the printed substrates. It may be used both at interstation locations where they would normally be placed close to the substrates S as well as in the stacking conveyor of the same press where they would normally be placed farther from the substrates S.

Figure 4:
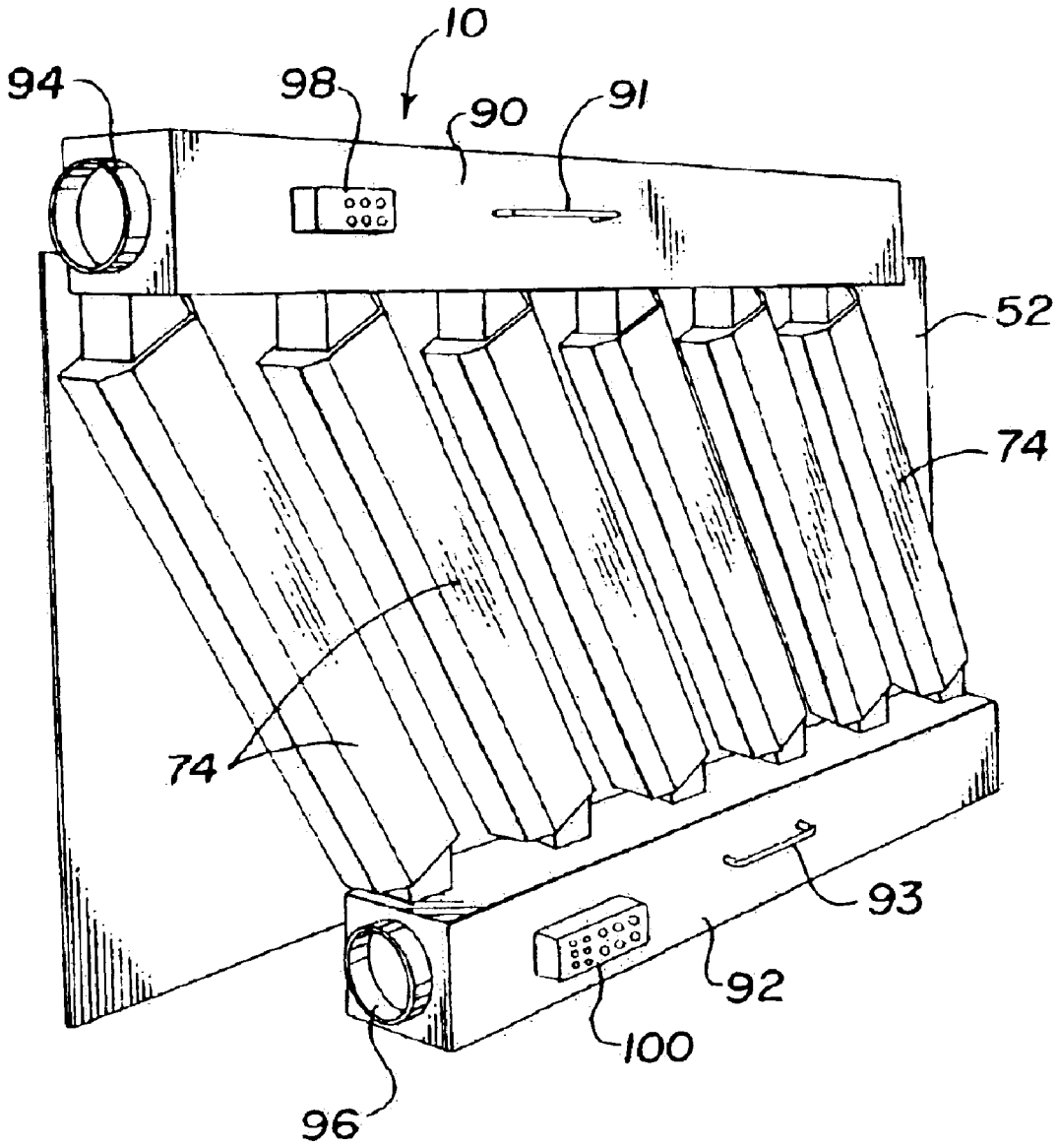
FIG. 4 is a perspective top view of an assembled UV curing unit according to the present invention.

FIG. 4 provides a perspective view of the FIG. 2 embodiment of an assembled UV curing unit 10 according to the present invention. As indicated in FIG. 2, the lamps 44–49 and the assemblies 68, FIG. 3, are assembled on a flat plate 52, having the apertures 50, FIG. 2. When assembled and viewed from the top, six of the air conduits 74 are positioned on the plate 52. A pair of air manifolds 90, 92 are positioned along two edges of the plate 52 at opposite ends of the air conduits 74. Each air conduit 74 has one end opening into manifold 90 and an opposite end opening into manifold 92. Fittings 94 and 96 are connected to one end of manifolds 90 and 92, respectively. The fittings 94, 96 are adapted to connect to an air hose, pipe, etc. for receiving a flow of cooling air. The flow of air may be a positive forced airflow or a suction or vacuum flow. In either case, airflow will be supplied to the air conduits 74 in each lamp housing 68 to cool the heat sink 72 and to thereby cool the lamps 44–49.

A pair of quick connect couplings 98 and 100 are mounted on the manifolds 90 and 92, respectively. Each coupling 98, 100 has six separate electrical sockets providing individual electrical connections for each end of each of the lamps 44, 49. In this way, the power to each lamp may be separately controlled. Coupling 100 also contains six air hose couplings for receiving a supply of pressurized air. The electrical connections, i.e. wiring, from couplings 98, 100 to the lamps 44, 49 are conveniently located within the air manifolds 90, 92. The pressurized air tubes from the coupling 100 are also positioned in the air manifold 92 and connected to the air tubes 76 shown in FIG. 3.

The complete UV curing unit shown in FIG. 4 may be mounted in a printing press 12 as shown in FIG. 1 by bolting through appropriately placed holes in the plate 52. The quick connect couplings 98, 100 reduce the time required to install and remove the curing unit 10 in and from a printing press. In some printing operations, part of the printing jobs will not use any UV curing inks or coatings. It may be desirable to remove the UV curing unit 10 during such jobs to avoid collecting dust or powder often intentionally used in printing with conventional inks. The quick connect couplings 98, 100 and modular assembly of the curing unit 10 facilitate such installation and removal. It may also be desirable to provide handles 91 and 93 attached to air manifolds 90 and 92 respectively for safe and efficient handling of the curing unit 10 during installation and removal. For some press types, it may be desirable to place the handles 91, 93 on the plate 52 instead of on the manifolds 90, 92.

Figure 5:
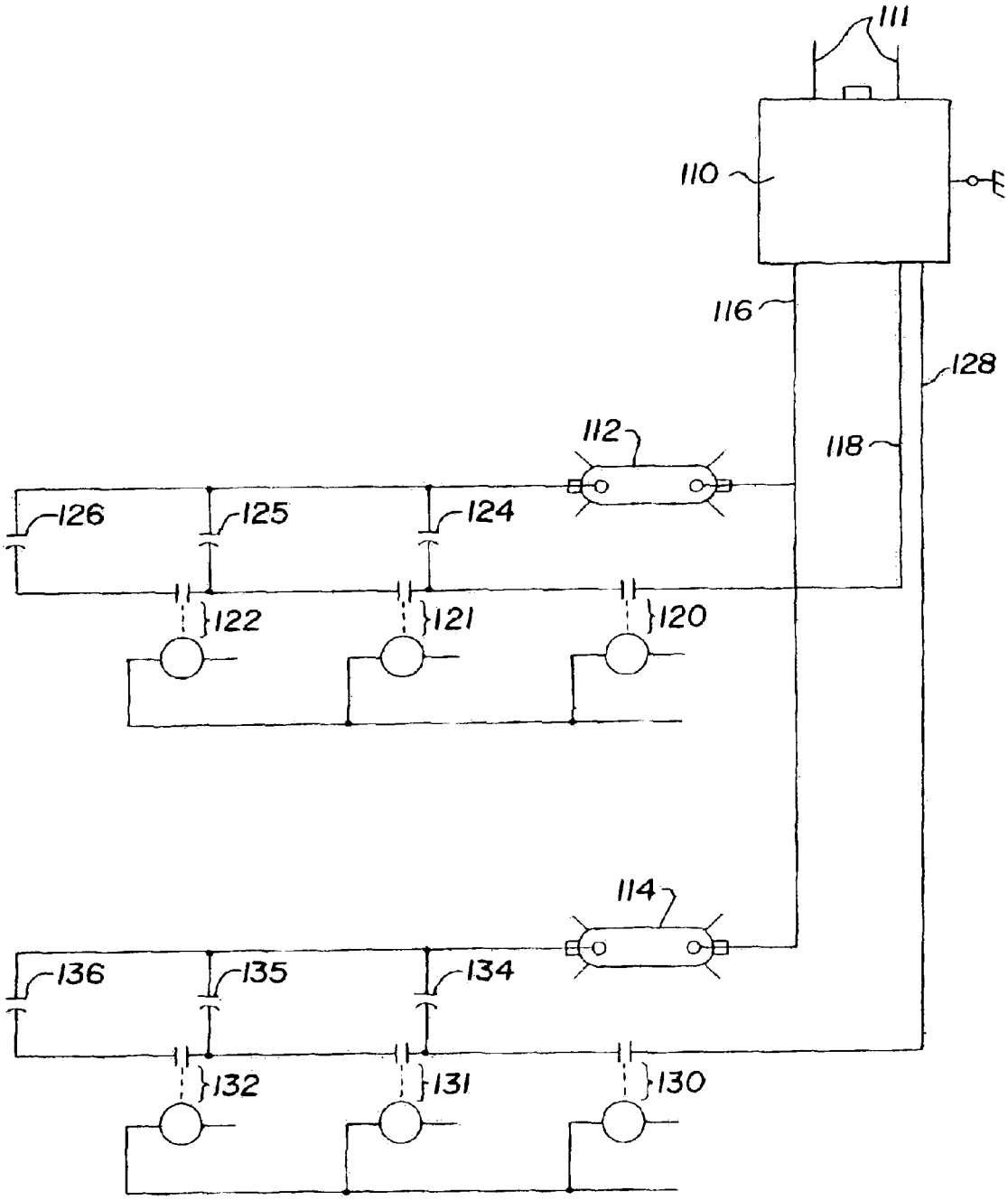
FIG. 5 is a schematic diagram of a portion of an electrical power supply and control system for powering the UV curing unit according to the present invention.

FIG. 5 is a schematic diagram of a portion of an embodiment of an electrical system for providing power to the lamps 44–49 of FIG. 2. This system includes a dual output ballast, or transformer, 110 providing power for two lamps 112 and 114. A first end of each lamp 112, 114 is connected to a common output 116 of the ballast 110. A power output 118 of ballast 110 is coupled through a set of three relays 120, 121 and 122 and three capacitors 124, 125 and 126 to a second end of lamp, 112. A power output 128 of ballast 110 is coupled through a set of three relays 130, 131 and 132 and three capacitors 134, 135 and 136 to a second end of lamp 114.

In this embodiment, inputs 111 of ballast 110 are provided with power from two phases of a 480 volt three phase power line. The outputs 118 and 128 provide a voltage of 460 volts to the lamps 112, 114 relative to the common lead 116. This relatively low lamp voltage is one of the advantages of using lamps 44–49 which are only twelve inches long. There are many standard electrical components, such as wire insulation, relays 120–122, 130–132, and capacitors 124–126, 134–136 which are rated for 600 volts. Longer lamps generally require voltages greater than 600 volts. While electrical components can be obtained with voltage ratings greater than 600 volts, they tend to be much more expensive. Voltages above 600 volts also require greater safety precautions.

The FIG. 5 circuitry provides independent control of power to each lamp 44–49 and provides three different selectable power levels. For example, closing of relay 120 allows current to flow through capacitor 124 to the lamp 112. Closing of relays 120 and 121 allows current to flow through both capacitors 124 and 125 to lamp 112. Closing of relays 120, 121 and 122 allows current to flow through all three capacitors 124, 125 and 126 to lamp 112. By proper selection of the capacitors 124–126, three power levels of, for example, 125 watts per inch, 250 watts per inch and 400 watts per inch may be supplied to lamp 112. Power levels above 400 watts per inch are generally not preferred because the relative proportion of useful UV radiation drops off at higher power levels, i.e. efficiency is reduced.

It is apparent that the circuitry of FIG. 5 may be modified in various ways while providing multiple selectable power levels for each lamp 44–49. For example, additional relays and capacitors may be added to provide a greater number of power levels. If two relays are connected between the ballast power lead and two capacitors having different values, three power levels (four if zero power is considered one power level) may be provided by selecting one or both of the relays. In the same way, a set of three capacitors with different values and three relays can be used to provide eight power levels, if zero power is considered one level.

It would also be desirable to provide continuous control of power supplied to the lamps 44–49 which would effectively provide an infinite number of power settings. Various commercially available controlled fluorescent ballasts or electronic ballasts may be used in place of the circuitry of FIG. 5 to provide such continuous or infinite control of power to each of the lamps 44–49.

The lamps 112, 114 shown in FIG. 5 may be any two of the lamps 44–49 of FIG. 2. If lamps 44 and 49 are driven by a single ballast, it is possible to remove power completely from the ballast under operating conditions where lamps 44 and 49 are not needed. Likewise it is desirable to have lamps 45 and 48 powered from the same ballast. In any case, three sets of the circuitry shown in FIG. 5 provide three selectable power levels to each of a set of six lamps, e.g. lamps 44–49 of FIG. 2. The relays 120–122 and 130–132 of FIG. 5 may be controlled by manual switches if desired, but are preferably controlled by a computer or programmed logic array in accordance with inputs provided by a system operator and/or by connection to the press controller. For example, the operator may input the width of substrate S and the types, colors and thickness of UV inks and coatings used in each zone for a particular printing job. Some of these inputs may be automatically supplied from ink fountain control signals used by the press 12. In response to such inputs, the system drives the appropriate relays 120–122 etc. to activate lamps 44–49, etc. at appropriate power levels for zones 54–59 as needed.

Both the thickness and color of the UV curable inks and coatings determine the intensity of UV radiation and dwell time required to get a full cure. Coatings are generally thin and transparent, even if tinted, and therefore normally require less UV power. UV inks are normally opaque and effectively increase the thickness if covered by a coating and therefore require more UV power to cure through to the substrate. For a given printing job, the lamps 44–49 which are powered may be powered at different levels depending on what inks and coatings are applied to each of the zones 54–59, FIG. 2. For example, if the only UV curable material in zone 55 is a clear UV coating, the lowest power level may be sufficient for full curing of zone 55. If zone 56 includes a darker UV coating or UV inks, the highest power level may be needed for that zone. It is also known that coatings and inks tend to be thicker near the outer edges of a substrate S than in the middle. Therefore, even if the same coating is desired across the entire width of the substrate S, lamps near the edges should normally be at a higher power setting than those near the center of the substrate S. Since the ink fountain control system normally provides signals to supply the proper amount of each ink color and coatings to the proper locations in the press, in one embodiment these signals can be used as control inputs to a programmed logic array to select which lamps 44–49 should be activated and which power level should be supplied.

Various changes in the dimensions, angles and positioning of lamps 44–49 may be made while still obtaining benefits of this embodiment. More or fewer lamps may be used. Longer or shorter lamps may be used. Some of these changes may facilitate use of a curing unit 10 in various makes and models of presses which have different spaces available for mounting the curing unit 10. The changes may also be based on the desired dwell time, which may be affected by types of UV curable coatings and inks and speed of the press. The changes may be based on the particular types of lamps used as UV sources, since different types of lamps may provide different UV intensity levels and different frequencies.

The above-described embodiment provides a six-zone UV curing unit for a press having a nominal forty-inch printing width. This embodiment can easily be expanded for use in presses having other nominal printing widths such as eighty inches or 113 inches or more, e.g. flexographic presses may be as wide as 130 inches. For example, for an eighty-inch press, the width of plate 52 could be doubled and the number of apertures 50 and lamp housings 68 could be doubled. The tilt angle and spacing between lamp housings could be the same. This may be accomplished by using two of the curing units 10 side by side.

For a given width press, for example the forty inch press of this embodiment, the number of lamps may be increased or decreased if desired. For example, it may be desired to add a seventh lamp to the curing unit 10. This would increase the overall UV power available from the curing unit. The tilt angle could be decreased to about 25 to 27 degrees and the spacing between lamp housings 68 could be reduced. The reduced angle increases the dwell time for any given point on the substrate S, increasing the total power delivered to that point. In similar fashion, if it is desired to use only five lamps, the tilt angle may be increased to about 40 degrees and spacing between lamp housings increased.

As noted above, various changes in the dimensions, angles and positioning may be made while still obtaining benefits of this embodiment. For example, since the alignment of the linear lamps 44–49 with the direction of travel of substrate S provides a longer dwell time for curing, it may be desirable to use lamps longer than twelve inches. This change could provide longer dwell time if the same number of lamps were still used. The longer lamps would be tilted from the travel path 42 by less than the 33 degree angle used in the above described embodiment. The lesser angle may be selected to achieve about the same end overlap of the lamps to achieve uniform UV intensity across the width of the substrate S. However, if lamps longer than 12 inches are used, the voltage required to drive the lamps may be greater than 600 volts and some of the electrical component and safety advantages of the preferred embodiment may be lost.

It would also be possible to use fewer longer lamps, e.g. five eighteen inch lamps for a 40 inch wide press, tilted at about the same angle as this embodiment. However, this would result in loss of a number of advantages. There would be fewer zones and therefore less chance to save power, reduce UV exposure of system components, etc. by turning off unnecessary zones. A higher voltage may be required. Essentially no actual increase in dwell time would result.

The particular lamp tilt angle is preferably selected to be as small as needed to obtain uniform illumination across the width of the substrate S. The lowest angle provides the greatest dwell time for a lamp of a given length. Angles less than 45 degrees provide a substantial increase in dwell time as compared to a conventional transverse lamp. Therefore, angles between zero and 45 degrees are preferred. Since it should not matter which way the lamps are tilted, the preferred angle may also be expressed as between plus or minus 45 degrees. The preferred angle for any given press depends on the maximum substrate width for the press, the number of desired zones, and the specific geometry which provides enough lamp end overlap to provide uniform illumination across the substrate width. For any given lamp length, these factors can be used to select the preferred tilt angle in view of the above described embodiments. For the embodiment of FIG. 2, the lamp angle is about 33 degrees. If a seventh lamp is added, the angle would be reduced to about 26 degrees. Thus it is more preferred that the angle be less than 35 degrees and even more preferred that it be less than about 28 degrees, all measured on either side of the direction of substrate travel.

In this embodiment, two of the UV curing units 10 are provided for a forty inch wide press. The two units 10 may be positioned in series, i.e. one is downstream of the other. For a given printing job only one may need to be powered. But for jobs using thick or colored coatings or dark UV ink, it may be necessary to use both curing units. By using two units in series and a FIG. 5 lamp power system with three power settings for each lamp, a total of six power settings are effectively available for each curing zone. If an electronic ballast or controlled fluorescent ballast is used to power the lamps, continuous control is possible. By using two curing units 10 in series, the dwell time for each zone can be increased without the disadvantages, such as higher voltage, which would occur if lamp length is increased to attain longer dwell time.

Figure 6:
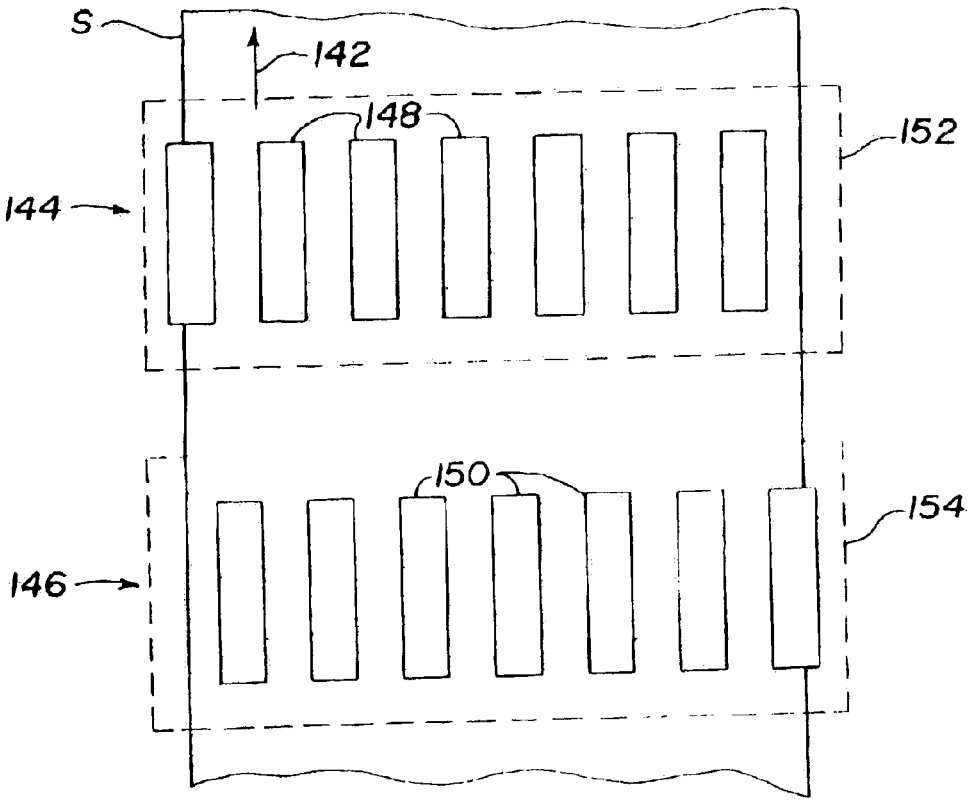
FIG. 6 is a top view of an alternative embodiment of a UV curing unit according to the present invention and a printed substrate passing under the curing unit.

FIG. 6 illustrates an alternate embodiment in which UV lamps can be aligned with the direction of the substrate travel path without any tilt, so long as two curing units 10 are used at the same time. This alignment provides the greatest dwell time for a lamp of a given length. As noted above with reference to FIG. 2, each lamp 44–49 and reflector 70 produces a substantially uniform illumination of a substrate area at least equal to the area of apertures 50. The illustrated arrangement ensures that all portions of a substrate S will travel directly under one of the lamp housings.

In FIG. 6, the substrate S is shown moving from bottom to top under two UV curing units 144 and 146. Each curing unit 144, 146 is represented by seven apertures 148 and 150 in mounting plates 152 and 154 respectively. Each aperture may have dimensions of about three by twelve inches. The long dimension of each aperture 148. 150 is aligned with the direction 142 of travel of substrate S. As illustrated in FIGS. 2, 3 and 4, a UV lamp assembly is mounted above each of the apertures 148, 150. The apertures 148 are spaced apart laterally across the substrate S by about three inches, i.e. the width and spacing are the same. The apertures 150 are likewise spaced laterally across the substrate S by about three inches, but are offset from apertures 148 by the same amount. Thus the edges of apertures 148 are aligned with the edges of apertures 150 and with the direction 142 of the substrate travel path. The combination of curing units 144 and 146 provides uniform illumination over a forty-two inch width divided into fourteen separately controlled zones, each three inches wide. This covers the maximum forty inch width of substrates S of this embodiment. With the power system of FIG. 5, it provides three levels of power for each zone and allows each zone to be turned off if not needed for a particular job. This FIG. 6 embodiment is easily expanded to any required press width by simply increasing the width of plates 152, 154 and adding more lamps to increase the number of curing zones and the width of the travel path which can be illuminated.

During development of the above described embodiments, several assumptions were made concerning the spacings of lamp assemblies 68 and the radiation pattern generated by the assemblies. Initially, it was believed that at least about one inch space was needed between adjacent lamp assemblies 68 to allow access for changing lamps, cleaning, etc. It was also believed that desirable UV intensity would be achieved only directly below the assemblies 68, that is over a space corresponding the apertures 50 in FIG. 2 and 148, 150 in FIG. 6. Upon testing of the first embodiment, it was found at least for some lamp assemblies that high level UV radiation was provided to an area wider than the apertures 50. It was also discovered, at least for some lamp assemblies, that the assemblies 68 could be placed side by side essentially in contact with each other.

Figure 7:
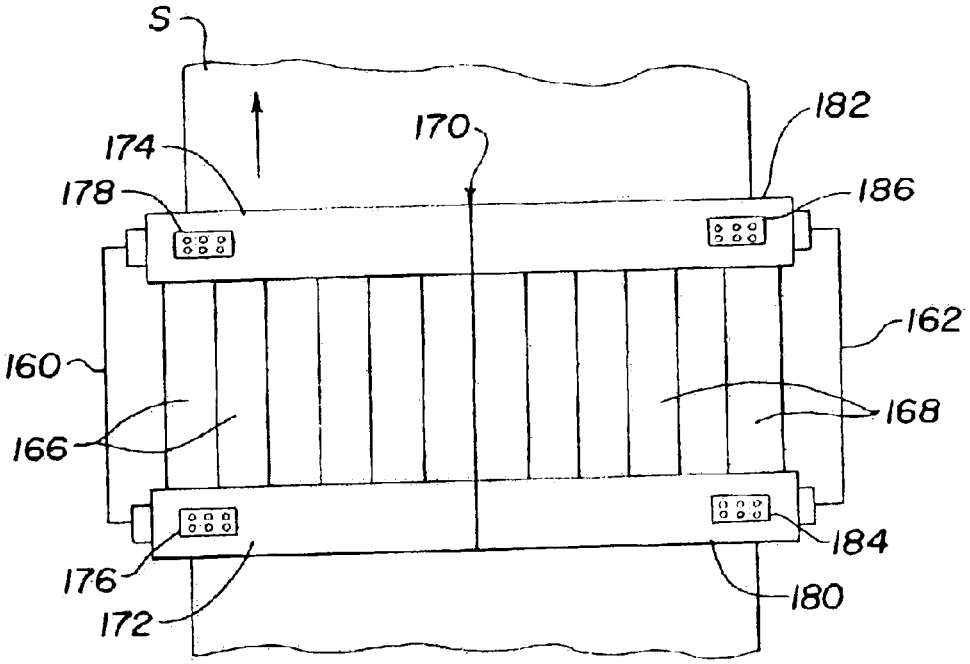
FIG. 7 is a top view of another alternative embodiment of a UV curing unit according to the present invention and a printed substrate passing under the curing unit.

FIG. 7 illustrates another embodiment in which a plurality of linear UV sources are placed directly in alignment with the path of a substrate S. In this embodiment, mirror image curing units 160 and 162 each include six lamp assemblies 166 and 168 respectively, each of which may be the same as the assembly 68 of FIG. 3. The units 160, 162 are placed adjacent each other, meeting on a center line 170 of the substrate S. Each lamp assembly 166, 168 is positioned over an aperture as shown in the previous embodiments. In this embodiment, the apertures may be separated by as little as one eighth of an inch. This spacing places adjacent lamp assemblies 166, 168 essentially in contact with each other. Curing unit 160 includes two air manifolds 172, 174 for providing cooling air to the assemblies 166. Quick connect blocks 176 and 178 are provided for electrical and air connections for lamp assemblies 166, in the same manner as described above for other embodiments. Likewise, curing unit 162 includes air manifolds 180 and 182 and quick connect blocks 184 and 186.

The lamp assemblies 166 and 168 provide good UV illumination over a substrate S area wider than the lamp assemblies 166, 168. The overlapping radiation patterns of the lamp assemblies 166, 168 provide uniform UV illumination across the full width of substrate S as it moves under the FIG. 7 embodiment. With the arrangement shown in FIG. 7, the curing units 160, 162 can provide UV curing for a substrate S of up to forty inches in width. In this embodiment, the center to center spacing of the outermost lamps is about forty inches, so that they are centered on the edges of a forty inch substrate S. It provides twelve curing zones across this substrate width. With the power circuitry of FIG. 5, each zone may have three different power levels. With modified circuitry or use of electronic ballasts, more power levels, or continuously variable power levels may be provided for each zone.

As discussed above, it is typical for coatings and inks to be thicker near the edges of a substrate S as compared to the center of the substrate S, even when a uniform coating is desired. The FIG. 7 embodiment provides the maximum number of curing zones across the substrate S, and allows lamp intensity to be adjusted across the Substrate S in about three inch increments to provide the needed curing. That is, the lamps near the edges can be at the highest power level, while those near the center can be at lower power levels. This embodiment also provides the greatest flexibility in terms of printing substrates S which are more narrow than the press capacity, e.g. less than forty inches in this embodiment. That is, the outer lamps may be turned off in about three inch increments to save power and avoid press damage when narrow substrates S are being printed.

The two curing units 160, 162 of FIG. 7 could be assembled as one unit, i.e. assembled on one mounting plate, if desired. However, such a unit would be of a size and/or weight that would make it difficult for one person to handle safely. While this would still achieve many of the benefits of the present disclosure, it would be contrary to one desirable feature of the invention, which is the ability to quickly and easily install and remove the UV curing unit from a press. As a result, it is preferred that for curing units having more than about six lamp assemblies, the UV curing unit be assembled in two or more sections which are installed side by side in the press to achieve the desired curing width.

Operation of the present disclosure will be described with reference to the FIG. 4 embodiment, with the understanding that any of the other embodiments may also be used. At least one curing unit 10 is installed in a printing press as illustrated in FIG. 1. Electrical connections are made to a power supply and control unit, FIG. 5. An air blower or suction line is connected to one of the couplings 94, 96, FIG. 4. It is preferred that the air used to cool the lamps 44–49 be filtered to avoid clogging the cooling fins 82. A pressurized air supply is connected to the cooling tubes 76. The air supplies should be activated before power is supplied to the lamps 44–49. For a given printing job, the width of the printing substrate S is determined. If it is less than 40 inches, then only enough of the lamps 44–49 are powered to provide UV curing across the width of the substrate S. If only a clear UV coating needs to be cured, power to the selected lamps may be set at the low or medium levels. If desired, a thermal dryer 38 and UV initiator lamp 44 may be installed and activated. The printing press 12 is then operated to print substrates S from sheet feeder 16 which are then dried and cured as they pass through conveyor 30 before being stacked in the delivery stacker 18.

The UV curing units of the present disclosure may also be installed and operated at interstation locations as indicated above. Other than the change in location, the units may be installed and operated in the same manner as when they are installed in the delivery conveyor system.

While the present invention has been illustrated and described in terms of particular apparatus and methods of use, it is apparent that equivalent parts may be substituted of those shown and other changes can be made within the scope of the present invention as defined by the appended claims.

We claim:

1. A zoned UV curing assembly for a printing press having a substrate travel path, comprising:

a plurality of linear UV omitting devices generally aligned with the substrate travel path, spaced laterally across the travel path, and positioned to emit UV radiation onto a plurality of curing zones across the travel path, a power supply having outputs separately coupled to each of said UV emitting devices, and connector blocks mounted on the curing assembly and having one electrical socket connected to each end of each emitting device, whereby electrical connection and disconnection of the power supply outputs to the emitting devices may be quickly made.

2. A zoned UV curing assembly according to claim 1, further comprising a control unit coupled to said power supply for selectively applying power to said plurality of UV emitting devices.

3. A zoned UV curing assembly according to claim 2, wherein said power supply provides variable power levels for each UV emitting device.

4. A zoned UV curing assembly according to claim 3, wherein said control unit selectively applies variable power levels to each UV emitting device.

5. A zoned UV curing assembly according to claim 3, wherein said power supply provides three power levels for each UV emitting device.

6. A zoned UV curing assembly according to claim 1, wherein said UV emitting devices comprise tubular lamps having a central axis generally aligned with the substrate travel path.

7. A zoned UV curing assembly according to claim 6, wherein the central axes of said lamps are slanted relative to said travel path sufficiently so that substantially all parts of a substrate moving in said travel path pass directly below at least some portion of at least one of said lamps.

8. A zoned UV curing assembly according to claim 7, wherein the central axes of said lamps are slanted relative to said travel path by less than 45 degrees.

9. A zoned UV curing assembly according to claim 7, wherein the central axes of said lamps are slanted relative to said travel path by less than 35 degrees.

10. A zoned UV curing assembly according to claim 7, wherein the central axes of said lamps are slanted relative to said travel path by less than 28 degrees.

11. A zoned UV curing assembly according to claim 6, wherein said UV emitting devices are mercury vapor lamps.

12. A zoned UV curing assembly according to claim 6, wherein said tubular lamps have a nominal length of about twelve inches.

13. A zoned UV curing assembly according to claim 12, further comprising a supply of pressurized air positioned to flow air across each of the tubular lamps, whereby upon deactivation of the lamps cooling is accelerated and restart time is reduced.

14. A zoned UV curing assembly according to claim 1, further comprising an initiator UV lamp positioned transversely across said travel path upstream from said plurality of UV emitting devices.

15. A zoned UV curing assembly according to claim 1, further comprising a heating assembly positioned across said travel path upstream from said plurality of linear UV emitting devices.

16. A zoned UV curing assembly according to claim 15, wherein said heating assembly comprises IR heat lamps and control means for heating substrates on said travel path to a preselected temperature.

17. A zoned UV curing assembly according to claim 1, wherein each of said UV emitting devices comprises:

a tubular lamp, and a generally half cylindrical reflector positioned above said lamp, said reflector having a generally rectangular aperture having a width, said lamp positioned within said reflector to direct radiation from said lamp substantially uniformly through said aperture.

18. A zoned UV curing assembly according to claim 17, wherein each of said UV emitting devices further comprises a heat sink having an inner surface conforming to the half cylindrical reflector and having an outer surface comprising heat transfer fins.

19. A zoned UV curing assembly according to claim 18, wherein each of said UV emitting devices further comprises an air conduit carried on said heat sink and providing a flow path for directing air flow over said heat transfer fins.

20. A zoned UV curing assembly according to claim 19, further comprising a first air manifold, connected to a first end of each air conduit, a second air manifold, connected to a second end of each air conduit, and an air supply connected to at least one of said first and second air manifolds, flowing air through said air conduits and across the heat transfer fins.

21. A zoned UV curing assembly according to claim 17, wherein said apertures are slanted relative to said travel path sufficiently so that substantially all parts of a substrate moving on said travel path pass directly below at least some portion of at least one of said apertures.

22. A zoned UV curing assembly according to claim 17, wherein:

said curing assembly comprises two rows of UV emitting devices spaced across said travel path, each device having a central axis substantially aligned with the travel path, a first row of UV emitting devices spaced apart from each other by the width of said apertures, a second row of UV omitting devices spaced apart from each other by the width of said apertures, said first row aperture laterally displaced from said second row apertures by the width of said apertures.

23. A zoned UV curing assembly according to claim 1, wherein:

said curing assembly comprises one row of emitting devices spaced across said travel path, each device having a central axis substantially aligned with the travel path, and said emitting devices are closely spaced, whereby illumination from each emitting device overlaps illumination from adjacent emitting devices.

24. A zoned UV curing assembly according to claim 1, further comprising at least one handle coupled to the UV curing assembly, whereby said assembly may be manually installed in and removed from a printing press.

25. A zoned UV curing assembly for a printing press having a substrate travel path comprising:

a plurality of linear UV emitting devices generally aligned with the substrate travel path, spaced laterally across the travel path, and positioned to emit UV radiation onto a plurality of curing zones across the travel path, the UV emitting devices comprising tubular lamps having a central axis generally aligned with the substrate travel path;

a supply of pressurized air positioned to flow air across each of the tubular lamps, whereby upon deactivation of the lamps cooling is accelerated and restart time is reduced; and, connector blocks mounted on the curing assembly and having one airflow socket connected to each emitting device, whereby connection and disconnection of the supply of pressurized air to the emitting devices may be quickly made.

* * * * *

UNITED STATES PATENT AND TRADEMARK OFFICE

CERTIFICATE OF CORRECTION

PATENT NO. : 6,807,906 B1
DATED : October 26, 2004
INVENTOR(S) : Howard W. DeMoore et al.

It is certified that error appears in the above-identified patent and that said Letters Patent is hereby corrected as shown below:

Column 13,
Line 12, replace “omitting” with -- emitting --.
Line 44, replace “in” with -- on --.

Column 14,
Line 49, replace “omitting” with -- emitting --.

Signed and Sealed this

First Day of February, 2005

JON W. DUDAS
*Director of the United States Patent and Trademark Office*